US011885543B2

(12) United States Patent
Mi et al.

(10) Patent No.: US 11,885,543 B2
(45) Date of Patent: Jan. 30, 2024

(54) REFRIGERANT SYSTEM OPERATION SEQUENCES FOR LEAK PREVENTION

(71) Applicant: Carrier Corporation, Palm Beach Gardens, FL (US)

(72) Inventors: Tingcan Mi, Shanghai (CN); Hai Tian, Shanghai (CN); Hui Li, Shanghai (CN); Chengwei Tang, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 15/734,219

(22) PCT Filed: Sep. 2, 2020

(86) PCT No.: PCT/US2020/049034
§ 371 (c)(1),
(2) Date: Dec. 1, 2020

(87) PCT Pub. No.: WO2021/046107
PCT Pub. Date: Mar. 11, 2021

(65) Prior Publication Data

US 2022/0196304 A1 Jun. 23, 2022

(30) Foreign Application Priority Data

Sep. 6, 2019 (CN) ..... 201910841812.1

(51) Int. Cl.
*F25B 49/02* (2006.01)
*F25B 47/02* (2006.01)

(52) U.S. Cl.
CPC ..... *F25B 49/02* (2013.01); *F25B 47/02* (2013.01); *F25B 2500/221* (2013.01);
(Continued)

(58) Field of Classification Search
CPC ..... F25B 47/02; F25B 2500/221; F25B 2500/222; F25B 2500/27; F25B 2600/2519; F25B 2700/1933
See application file for complete search history.

(56) References Cited

U.S. PATENT DOCUMENTS

2009/0031738 A1* 2/2009 Tamura ..... F25B 9/008 62/228.3
2016/0290713 A1* 10/2016 Twiggar, III ..... E05D 7/00
(Continued)

FOREIGN PATENT DOCUMENTS

EP 2416095 2/2012
EP 2416095 A2 2/2012
(Continued)

OTHER PUBLICATIONS

International Search Report for Application No. PCT/US2020/049034; dated Jan. 28, 2021; 8 pages.
(Continued)

*Primary Examiner* — Henry T Crenshaw
(74) *Attorney, Agent, or Firm* — CANTOR COLBURN LLP

(57) ABSTRACT

A method of shutting down a refrigeration system including: initiating a shutdown process of the refrigeration system; closing a first valve within a refrigerant circuit of the refrigeration system; operating a compressor within the refrigerant circuit; detecting a suction pressure within the refrigerant circuit; closing a second valve within the refrigerant circuit of the refrigeration system when the suction pressure is below a threshold suction pressure; and stopping operation of the compressor.

10 Claims, 4 Drawing Sheets

(52) U.S. Cl.
CPC ..... *F25B 2500/222* (2013.01); *F25B 2500/27* (2013.01); *F25B 2600/2519* (2013.01); *F25B 2700/1933* (2013.01)

(56) References Cited

U.S. PATENT DOCUMENTS

| | | | | |
|---|---|---|---|---|
| 2018/0187969 | A1* | 7/2018 | Kim | G06F 3/04883 |
| 2018/0209697 | A1* | 7/2018 | Nishida | G05D 23/1927 |
| 2020/0080757 | A1* | 3/2020 | Suzuki | F25B 41/22 |
| 2021/0302055 | A1* | 9/2021 | Noor | F25B 49/005 |

FOREIGN PATENT DOCUMENTS

| | | | |
|---|---|---|---|
| EP | 3598037 | A1 | 1/2020 |
| EP | 3637016 | A1 | 4/2020 |
| WO | 2018167820 | A1 | 9/2018 |
| WO | 2018225257 | A1 | 12/2018 |
| WO | WO 2018225257 | * | 12/2018 |

OTHER PUBLICATIONS

Written Opinion of the International Searching Authority for Application No. PCT/US2020/049034; dated Jan. 28, 2021; 11 pages.
PCT Invitation to Pay Additional Fees and, where applicable, protest fee; International Application No. PCT/US2020/049034; International Filing Date: Sep. 2, 2020; dated Nov. 13, 2020; pp. 1-10.

* cited by examiner

REFRIGERANT SYSTEM OPERATION SEQUENCES FOR LEAK PREVENTION

CROSS REFERENCE TO RELATED APPLICATIONS

This application is a National Stage application of PCT/US2020/049034, filed Sep. 2, 2020, which claims the benefit of Chinese Application No. 201910841812.1 filed Sep. 6, 2019, both of which are incorporated by reference in their entirety herein.

BACKGROUND

Exemplary embodiments pertain to the art of refrigerated systems. More specifically, transportation refrigeration units.

Cargo may be shipped or stored within a conditioned space, such as a container, truck or trailer. These conditioned spaces utilize a refrigeration unit that circulates cooled air inside the interior volume. In many cases, the refrigeration unit uses a refrigeration cycle to cool the air. Refrigerant from the refrigeration unit may leak inside the conditioned space.

BRIEF DESCRIPTION

According to an embodiment, a method of shutting down a refrigeration system is provided. The method including: initiating a shutdown process of the refrigeration system; closing a first valve within a refrigerant circuit of the refrigeration system; operating a compressor within the refrigerant circuit; detecting a suction pressure within the refrigerant circuit; closing a second valve within the refrigerant circuit of the refrigeration system when the suction pressure is below a threshold suction pressure; and stopping operation of the compressor.

In addition to one or more of the features described above, or as an alternative, further embodiments may include: receiving a selection input from a user of a refrigeration system control input device indicating that the user desires to initiate a shutdown process of the refrigeration system.

In addition to one or more of the features described above, or as an alternative, further embodiments may include: generating a graphical user interface on a display device of the refrigeration system control input device; and displaying a control icon representing initiation of the shutdown process, wherein the selection input is received at the control icon.

In addition to one or more of the features described above, or as an alternative, further embodiments may include: stopping operation of the refrigeration system.

In addition to one or more of the features described above, or as an alternative, further embodiments may include that the first valve is located within the refrigerant circuit between a condenser and an evaporator.

In addition to one or more of the features described above, or as an alternative, further embodiments may include that the second valve is located within the refrigerant circuit between the compressor and a condenser, and wherein closing the second valve stops flow of refrigerant from the compressor to the condenser.

In addition to one or more of the features described above, or as an alternative, further embodiments may include that the second valve is located between an evaporator outlet of an evaporator of the refrigeration system and a compressor inlet of the compressor, and wherein closing the second valve stops flow of refrigerant from the compressor to the condenser.

In addition to one or more of the features described above, or as an alternative, further embodiments may include that the suction pressure is detected proximate a compressor inlet of the compressor.

In addition to one or more of the features described above, or as an alternative, further embodiments may include that the first valve is located outside of a conditioned space of the refrigeration system.

In addition to one or more of the features described above, or as an alternative, further embodiments may include that closing the first valve and the second valve maintains the suction pressure below the threshold suction pressure.

According to another embodiment, a method of defrosting within a refrigeration system is provided. The method including: initiating a defrost process of the refrigeration system; closing a first valve within a refrigerant circuit of the refrigeration system; operating a compressor within the refrigerant circuit; detecting a suction pressure within the refrigerant circuit; closing a second valve within the refrigerant circuit of the refrigeration system when the suction pressure is below a threshold suction pressure; stopping operation of the compressor; and initiating the defrost process of the refrigeration system.

In addition to one or more of the features described above, or as an alternative, further embodiments may include: receiving a selection input from a user of a refrigeration system control input device indicating that the user desires to initiate the defrost process of the refrigeration system.

In addition to one or more of the features described above, or as an alternative, further embodiments may include: generating a graphical user interface on a display device of the refrigeration system control input device; and displaying a control icon representing initiation of the defrost process, wherein the selection input is received at the control icon.

In addition to one or more of the features described above, or as an alternative, further embodiments may include: activating a heater of the refrigeration system.

In addition to one or more of the features described above, or as an alternative, further embodiments may include that the heater is located proximate an evaporator of the refrigeration system.

In addition to one or more of the features described above, or as an alternative, further embodiments may include that the first valve is located within the refrigerant circuit between a condenser and an evaporator, and wherein closing the first valve stops flow of refrigerant from the condenser to the evaporator.

In addition to one or more of the features described above, or as an alternative, further embodiments may include that the second valve is located within the refrigerant circuit between the compressor and a condenser and wherein closing the second valve stops flow of refrigerant from the compressor to the condenser.

In addition to one or more of the features described above, or as an alternative, further embodiments may include that the second valve is located between an evaporator outlet of an evaporator of the refrigeration system and a compressor inlet of the compressor.

In addition to one or more of the features described above, or as an alternative, further embodiments may include that the suction pressure is detected proximate a compressor inlet of the compressor.

In addition to one or more of the features described above, or as an alternative, further embodiments may include closing the first valve and the second valve maintains the suction pressure below the threshold suction pressure.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
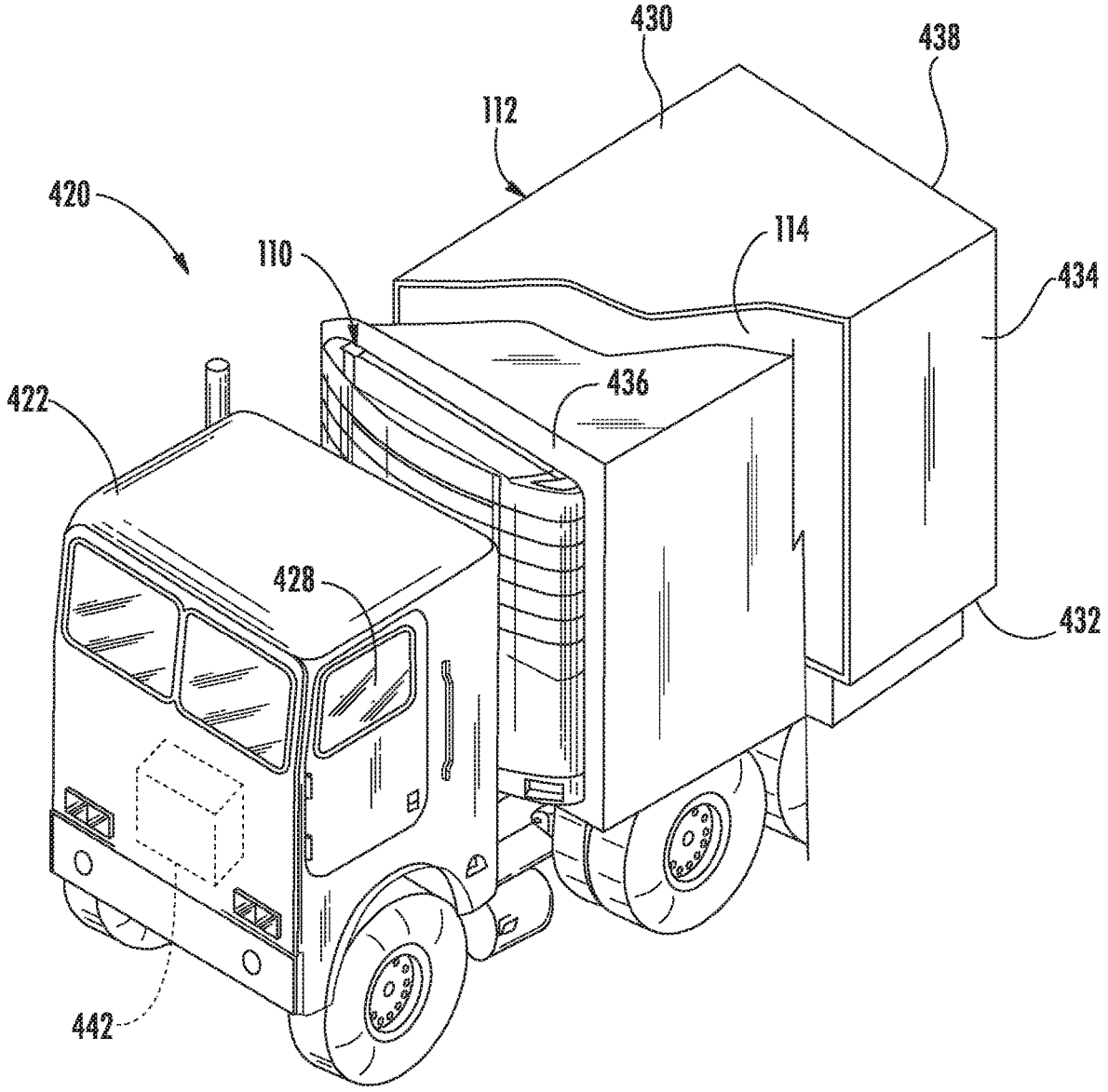
FIG. 1 is a perspective view of a transport system having a refrigeration system as one, non-limiting, according to an embodiment of the present disclosure.

Referring to FIG. 1, a transport system 420 of the present disclosure is illustrated. In the illustrated embodiment, the transport systems 420 may include a tractor or vehicle 422, a conditioned space 112, and a refrigeration system 110. The conditioned space 112 may be pulled by a vehicle 422. It is understood that embodiments described herein may be applied to conditioned space that are shipped by rail, sea, air, or any other suitable container, thus the vehicle may be a truck, train, boat, airplane, helicopter, etc.

The vehicle 422 may include an operator's compartment or cab 428 and a vehicle motor 442. The vehicle 422 may be driven by a driver located within the cab, driven by a driver remotely, driven autonomously, driven semi-autonomously, or any combination thereof. The vehicle motor 442 may be an electric or combustion engine powered by a combustible fuel. The vehicle motor 442 may also be part of the power train or drive system of the trailer system (i.e., conditioned space 112), thus the vehicle motor 442 is configured to propel the wheels of the vehicle 422 and/or the wheels of the conditioned space 112. The vehicle motor 442 may be mechanically connected to the wheels of the vehicle 422 and/or the wheels of the conditioned space 112.

The conditioned space 112 may be coupled to the vehicle 422 and is thus pulled or propelled to desired destinations. The conditioned space 112 may include a top wall 430, a bottom wall 432 opposed to and spaced from the top wall 430, two side walls 434 spaced from and opposed to one-another, and opposing front and rear walls 436, 438 with the front wall 436 being closest to the vehicle 422. The conditioned space 112 may further include doors (not shown) at the rear wall 438, or any other wall. The walls 430, 432, 434, 436, 438 together define the boundaries of a refrigerated interior volume 114. Typically, transport systems 420 are used to transport and distribute cargo, such as, for example perishable goods and environmentally sensitive goods (herein referred to as perishable goods). The perishable goods may include but are not limited to fruits, vegetables, grains, beans, nuts, eggs, dairy, seed, flowers, meat, poultry, fish, ice, blood, pharmaceuticals, or any other suitable cargo requiring cold chain transport. In the illustrated embodiment, the refrigeration system 110 is associated with a conditioned space 112 to provide desired environmental parameters, such as, for example temperature, pressure, humidity, carbon dioxide, ethylene, ozone, light exposure, vibration exposure, and other conditions to the refrigerated interior volume 114. In further embodiments, the refrigeration system 110 is a refrigeration system capable of providing a desired temperature and humidity range.

Figure 2:
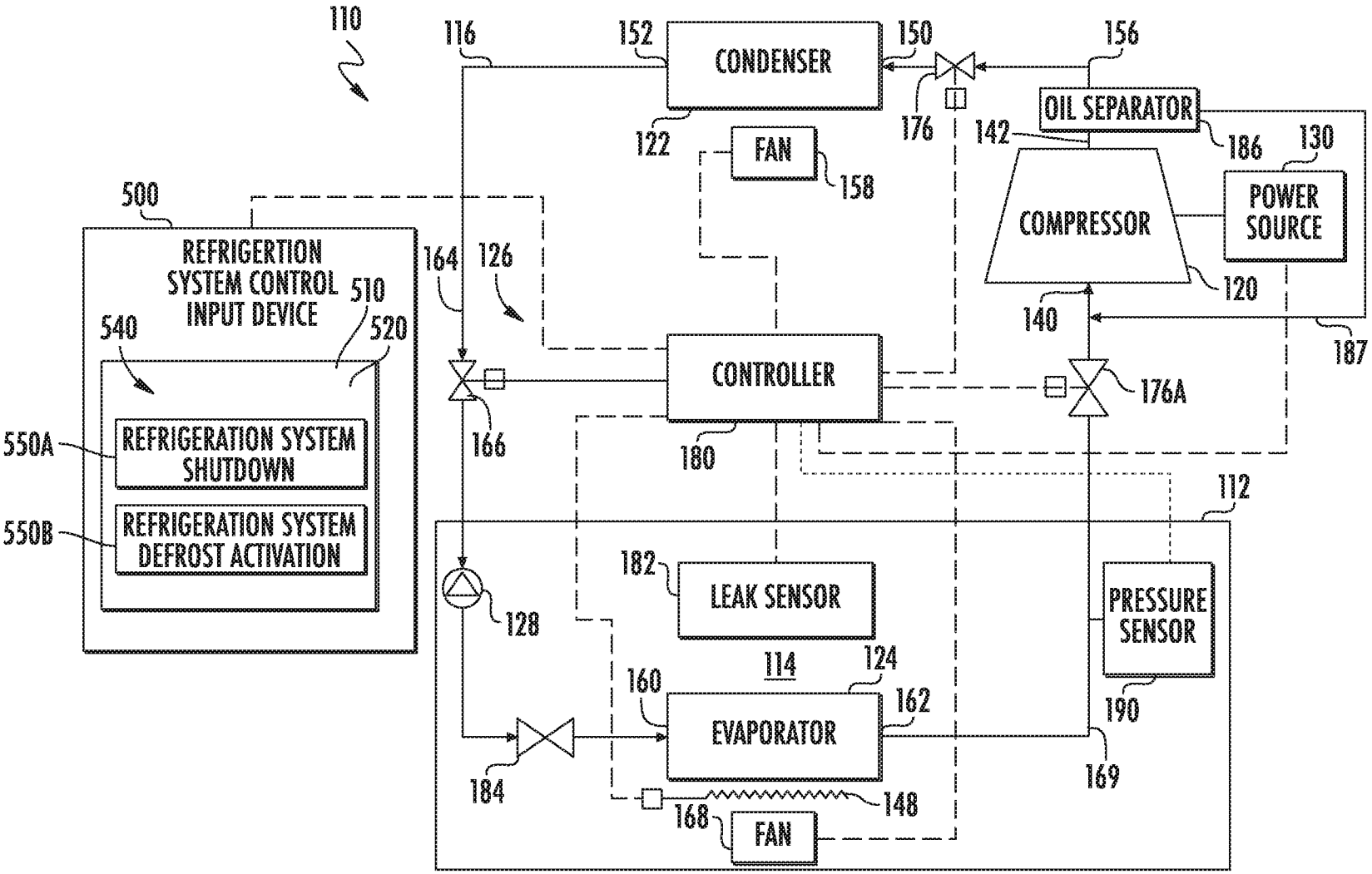
FIG. 2 is a schematic illustration of a refrigeration system, according to an embodiment of the present disclosure.

Referring to FIG. 2, a refrigeration system 110 is illustrated, in accordance with an embodiment of the present disclosure. A refrigeration system 110 that provides conditioned air or cooled air to an interior volume 114 of the conditioned space 112 is illustrated in FIG. 2. The conditioned space 112 may include but is not limited to a refrigerated trailer, a refrigerated truck, a refrigerated space, or a refrigerated container. The refrigeration system 110 may be adapted to operate using a refrigerant such as a low global warming potential refrigerant including A1, A2, A2L, A3, etc. In some case the refrigerant may leak into the interior volume 114 and may present a hazard should the concentration of the leaked refrigerant within the interior volume 114 exceed a threshold level. The threshold level may be a lower flammability limit of the refrigerant. The evaporator 124, a portion of a refrigerant line 169 proximate an evaporator outlet 162, and a portion of a refrigerant line 164 proximate an evaporator inlet 160 may be located within the interior volume 114 of the conditioned space 112 and thus may be a potential source of a refrigerant leak into the interior volume 114.

The refrigeration system 110 may be a transport refrigeration system such as a transportation refrigeration unit. The refrigeration system 110 includes a compressor 120, a condenser 122 and an evaporator 124. The refrigeration system 110 may optionally include a leak detection system 126 that is arranged to detect and mitigate the presence of refrigerant within an interior volume 114. Embodiments disclosed herein are also applicable to refrigeration systems 110 not including a leak detection system.

The compressor 120 is powered by or driven by a power source 130. The power source 130 may be an internal combustion engine that drives a generator that is arranged to provide power to the compressor 120 and other components of the refrigeration system 110, or that drives the compressor via belt directly.

The compressor 120 is arranged to receive refrigerant through a compressor inlet 140 from the evaporator 124. The compressor 120 is arranged to discharge refrigerant through a compressor outlet 142 to the condenser 122. The compressor 120 is configured to pump the refrigerant through a refrigerant circuit 116, which is composed of various components including but not limited to a refrigerant line 156, the refrigerant line 164, a refrigerant line 169, a first valve 166, a check valve 128, the evaporator 124, the condenser 122, and a second valve 176. The refrigerant line 156, the refrigerant line 164, the refrigerant line 169, the first valve 166, the check valve 128, the evaporator 124, the condenser 122, the second valve 176, and the compressor are located within the refrigerant circuit 116. The refrigerant circuit 116 is a closed circuit.

The condenser 122 is arranged to receive a fluid flow of refrigerant from the compressor 120 through a condenser inlet 150 and is arranged to discharge a fluid flow of refrigerant through a condenser outlet 152 to the evaporator 124. The condenser inlet 150 is fluidly connected to the compressor outlet 142 through the refrigerant line 156.

An oil separator 186 may be located within the refrigerant line 156 between the compressor 120 and the condenser 122 to remove oil from refrigerant leaving the compressor outlet 142 and direct the oil back to the suction line of the compressor 120 or back to body of compressor 120.

A fan such as a condenser fan 158 may be associated with the condenser 122. The condenser fan 158 is disposed proximate the condenser 122.

The evaporator 124 is arranged to receive a fluid flow of refrigerant from the condenser 122 through an evaporator inlet 160 and is arranged to discharge a fluid flow of refrigerant to the compressor 120 through an evaporator outlet 162. The evaporator inlet 160 is fluidly connected to the condenser outlet 152 through a refrigerant line 164. The evaporator outlet 162 is fluidly connected to the compressor inlet 140 through a refrigerant line 169.

A fan such as an evaporator fan 168 may be associated with the evaporator 124. The evaporator fan 168 is disposed proximate the evaporator 124.

A first valve 166 may be located within the refrigerant line 164 between the condenser 122 and the evaporator 124. In at least one embodiment, the first valve 166 is arranged to selectively facilitate a fluid flow between the condenser outlet 152 and the evaporator inlet 160. The first valve 166 may be an expansion valve such as an electronic expansion valve, a movable valve, a solenoid valve, or a thermal expansion valve. The first valve 166 is movable between an open position and a closed position to selectively facilitate and inhibit a fluid flow of refrigerant between the evaporator 124 and the condenser 122. The open position facilitates a fluid flow of refrigerant between the condenser outlet 152 and the evaporator inlet 160. The closed position inhibits a fluid flow of refrigerant between the condenser outlet 152 and the evaporator inlet 160 through the refrigerant line 164.

A second valve 176 may be located within the refrigerant line 156 between the compressor 120 and the condenser 122. In at least one embodiment, the second valve 176 is arranged to selectively facilitate a fluid flow between the compressor outlet 142 and the condenser inlet 150. The second valve 176 may be a movable valve, a liquid service valve, a thermal expansion valve, or an electronic expansion valve, or a check valve. The second valve 176 is movable between an open position and a closed position. The open position facilitates a fluid flow of refrigerant between the compressor outlet 142 and the condenser inlet 150. The closed position inhibits a fluid flow of refrigerant between the compressor outlet 142 and the condenser inlet 150 to selectively facilitate a fluid flow between the evaporator outlet 162 and the compressor inlet 140. In an alternate embodiment, the second valve 176 may be interposed between the evaporator outlet 162 and the compressor inlet 140, as shown in FIG. 2 at 176A.

In an embodiment, the first valve 166 and the second valve 176 may be located outside of the conditioned space 112.

The refrigeration system 110 may include a check valve 128 located within the refrigerant line 164 between the first valve 166 and the evaporator 124, as shown in FIG. 2. The refrigeration system 110 may also include an expansion valve 184 located within the refrigerant line 164 between the check valve 128 and the evaporator 124, as shown in FIG. 2. The refrigeration system 110 may additionally include a pressure sensor 190 located within the refrigerant line 169 interposed between the evaporator 124 and the compressor inlet 140.

The leak detection system 126 comprises a leak sensor 182 and the controller 180. The leak sensor 182 may be configured to detect refrigerant, detect a selected concentration of the refrigerant, and/or calculate a concentration of refrigerant. The leak sensor 182 may be located within the conditioned space 112. The controller 180 may be a controller that is provided with the transport refrigeration unit or may be a separately provided controller.

The controller 180 is provided with input communication channels that are arranged to receive information, data, or signals from, for example, at least one of the compressor 120, the power source 130, the condenser fan 158, the first valve 166, the evaporator fan 168, the second valve 176, and the leak sensor 182. The controller 180 is provided with output communication channels that are arranged to provide commands, signals, or data, for example, to the compressor 120, the power source 130, the condenser fan 158, the first valve 166, the evaporator fan 168, the pressure sensor 190, and the second valve 176. The controller 180 is provided with at least one processor that is programmed to execute a leak detection and/or leak mitigation strategy based on information, data, or signals provided via the input communication channels and output commands via the output communication channels.

The leak sensor 182 is arranged to provide a signal indicative of a concentration, an amount or the presence of refrigerant within the interior volume 114 to the controller 180. The leak sensor 182 may be disposed proximate the evaporator 124 and/or may be disposed proximate the refrigerant line 169 or any other refrigerant line or component that could leak refrigerant into the conditioned space 112. The leak sensor 182 may also be located near a likely location where refrigerant may collect such as near a floor of the conditioned space 112.

Responsive to the signal from the leak sensor 182 being indicative of a concentration of refrigerant greater than a threshold concentration or the signal being indicative of the presence of refrigerant within the interior volume 114, the controller 180 may perform leak mitigation as disclosed in U.S. Application No. 62/727,682 filed Sep. 6, 2018 and Chinese Application No. 201910312955.3, which are incorporated herein by reference in their entirety.

The refrigeration system 110 may also include a heater 148 associated with the evaporator 124. In an embodiment, the heater 148 may be an electric resistance heater. The heater 148 may be selectively operated by the controller 180 whenever a control temperature within the temperature controlled a conditioned space 112 drops below a preset lower temperature limit, which may occur in a cold ambient environment. In such an event, the controller 180 would activate the heater 148 to heat air circulated over the heater 148 by the fan 168 associated with the evaporator 124. The heater 148 may also be selectively operated by the controller 180 to defrost the evaporator 124. For example, the heater 148 may melt ice off of coils of the evaporator 124.

It is to be understood that other components (not shown) may be incorporated into the refrigerant circuit as desired, including for example, but not limited to, a suction modulation valve, a main heat valve, a hot gas valve, a receiver, a filter/dryer, an economizer circuit.

The refrigeration system 110 may be in electronic communication with a refrigeration system control input device 500 that may be located within the cab 428 of the vehicle 422. The refrigeration system control input device 500 may be an electronic controller including a processor and an associated memory comprising computer-executable instructions that, when executed by the processor, cause the processor to perform various operations. The processor may be, but is not limited to, a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory may be but is not limited to a random access memory (RAM), read only memory (ROM), or other electronic, optical, magnetic or any other computer readable medium.

The refrigeration system control input device 500 may be in wired and/or wireless communication with the refrigeration system 110. The refrigeration system control input device 500 may be a computing device located in the cab 428 operable to receive input commands from a user and transfer the input commands to the controller 180 of the refrigeration system 110. The refrigeration system control input device 500 may be securely attached to the cab 428 of the vehicle 422, such as, for example, to the dashboard or instrument panel of the vehicle 422. Alternatively, the refrigeration system control input device 500 may be a handheld or mobile computing device, such as, for example, a smart phone, a laptop, a tablet computer, a smart watch, or similar device known to one of skill in the art. The refrigeration system control input device 500 may include a display device 510 to convey data from the refrigeration system 110 to the user of the refrigeration system control input device 500.

The refrigeration system control input device 500 may generate a graphical user interface 540 via the display device 510 for viewing and controlling operation of the refrigeration system 110. The refrigeration system control input device 500 also includes an input device 520, such as, example, a mouse, a touch screen, a scroll wheel, a scroll ball, a stylus pen, a microphone, a camera, or similar device known to one of skill in the art. In the example shown in FIG. 2, the display device 510 is a touchscreen, thus the display device 510 also functions as the input device 520. FIG. 2 illustrates a graphical user interface 540 that may be generated on the display device 510 of the refrigeration system control input device 500. A user may interact with the graphical user interface 540 through a selection input, such as, for example, a "click", "touch", verbal command, gesture recognition, or any other input to the graphical user interface 540. The "click" or touch" may be via the input device 630.

The graphical user interface 540 may display control icons 550A, 550B for a user to selected. The control icons 550A, 550B control actions that may be performed by the refrigeration system 110, thus when a user selects a control icon 550A, 550B via a selection input the refrigeration system 110 may be prompted to perform that action associated with the control icon selected. The selection input may be received at or on the control icon 550A, 550B.

The control icon 550A may be associated with a shutdown of the refrigeration system 110 and thus the text "REFRIGERATION SYSTEM SHUTDOWN" may be displayed on the control icon 550A. When a user selects the control icon 550A via a selection input using the input device 520 then a command is sent to the controller 180 and the controller 180 will initiate a shutdown process of the refrigeration system 110, as discussed further in method 600 herein. It is understood that the embodiments disclosed herein are also applicable to automatic shutdown of the refrigeration system 110 without the need for a selection input.

The control icon 550B may be associated with a defrost of the refrigeration system 110 and thus the text "REFRIGERATION SYSTEM DEFROST ACTIVATION" may be displayed on the control icon 550B. When a user selects the control icon 550B via a selection input using the input device 520 then a command is sent to the controller 180 and the controller 180 will initiate a defrost process of the refrigeration system 110, as discussed further in method 700 herein. It is understood that the embodiments disclosed herein are also applicable to automatic defrost of the refrigeration system 110 without the need for a selection input.

Figure 3:
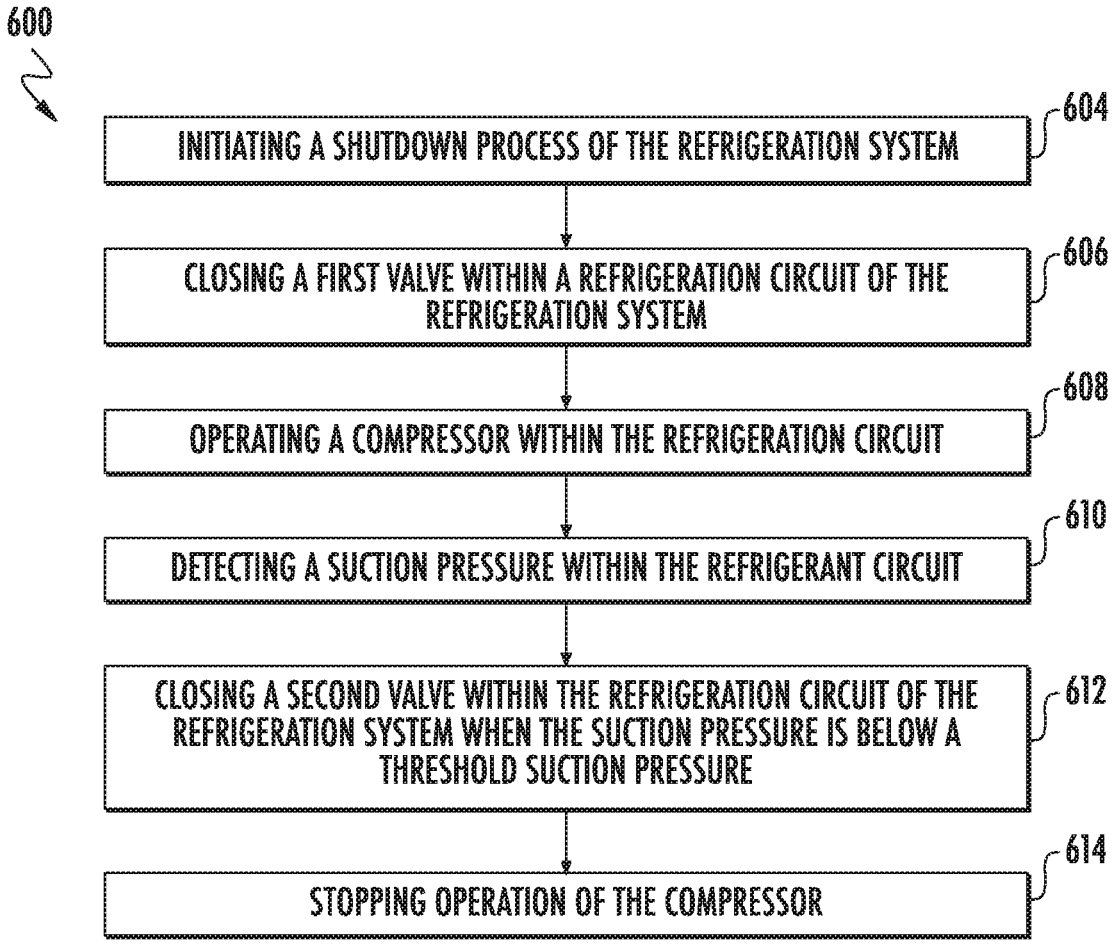
FIG. 3 is a flowchart illustrating a method of shutting down the refrigeration system of FIG. 2, according to an embodiment of the present disclosure.

Referring to FIG. 3, with continued reference to FIGS. 1 and 2, a method 600 of shutting down the refrigeration system 110 is illustrated in accordance with an embodiment of the present disclosure. In an embodiment, the method 600 may be performed by the controller 180 and/or the refrigeration system control input device 500.

At block 604, the shutdown process of the refrigeration system 110 is initiated. The shutdown process of the refrigeration system 110 may be initiated automatically or when a selection input is received from a user of a refrigeration system control input device 500 indicating that the user desires to initiate a shutdown process of the refrigeration system 110. Block 604 may include that a graphical user interface 540 is generated on a display device 510 of the refrigeration system control input device 500 and a control icon 550A representing initiation of the shutdown process is displayed. The selection input is received at the control icon 550A.

At block 606 a first valve 166 within a refrigerant circuit 116 of the refrigeration system 110 is closed. The first valve 166 is located within the refrigerant circuit 116 between the condenser 122 and the evaporator 124. Thus, closing the first valve 166 stops flow of refrigerant from the condenser 122 to the evaporator 124. In an embodiment, the first valve 166 is located outside of a conditioned space 112 of the refrigeration system 110.

At block 608, a compressor 120 within the refrigerant circuit 116 is operated. At block 610 a suction pressure within the refrigerant circuit 116 is detected. In an embodiment, the suction pressure is detected proximate a compressor 120 inlet of the compressor 120.

At block 612, a second valve 176 within the refrigerant circuit 116 of the refrigeration system 110 is closed when the suction pressure is below a threshold suction pressure. Closing the first valve 166 and the second valve 176 maintains the suction pressure below the threshold suction pressure. The second valve 176 may be located within the refrigerant circuit 116 between the compressor 120 and the condenser 122. Thus, closing the second valve 176 may stop flow of refrigerant from the compressor 120 to the condenser 122. In an embodiment, the second valve 176 is located outside of a conditioned space 112 of the refrigeration system 110. In an alternate embodiment, the second valve 176 may be interposed between the evaporator outlet 162 and the compressor inlet 140, as shown in FIG. 2 at 176A. The threshold suction pressure may be indicative that the refrigerant has been evacuated from the refrigerant circuit 116 between first valve 166 and the second valve 176. In other words, the threshold suction pressure may be indicative that the refrigerant has been evacuated from the refrigerant line 164 between the first valve 166 and the evaporator 124, the evaporator 124, the refrigerant line 169, the compressor 120, and the refrigerant line 156 between the compressor and the second valve 176.

At block 614, operation of the compressor 120 is stopped. The method 600 may also include stop operations of the refrigeration system 110.

While the above description has described the flow process of FIG. 3 in a particular order, it should be appreciated that unless otherwise specifically required in the attached claims that the ordering of the steps may be varied.

Figure 4:
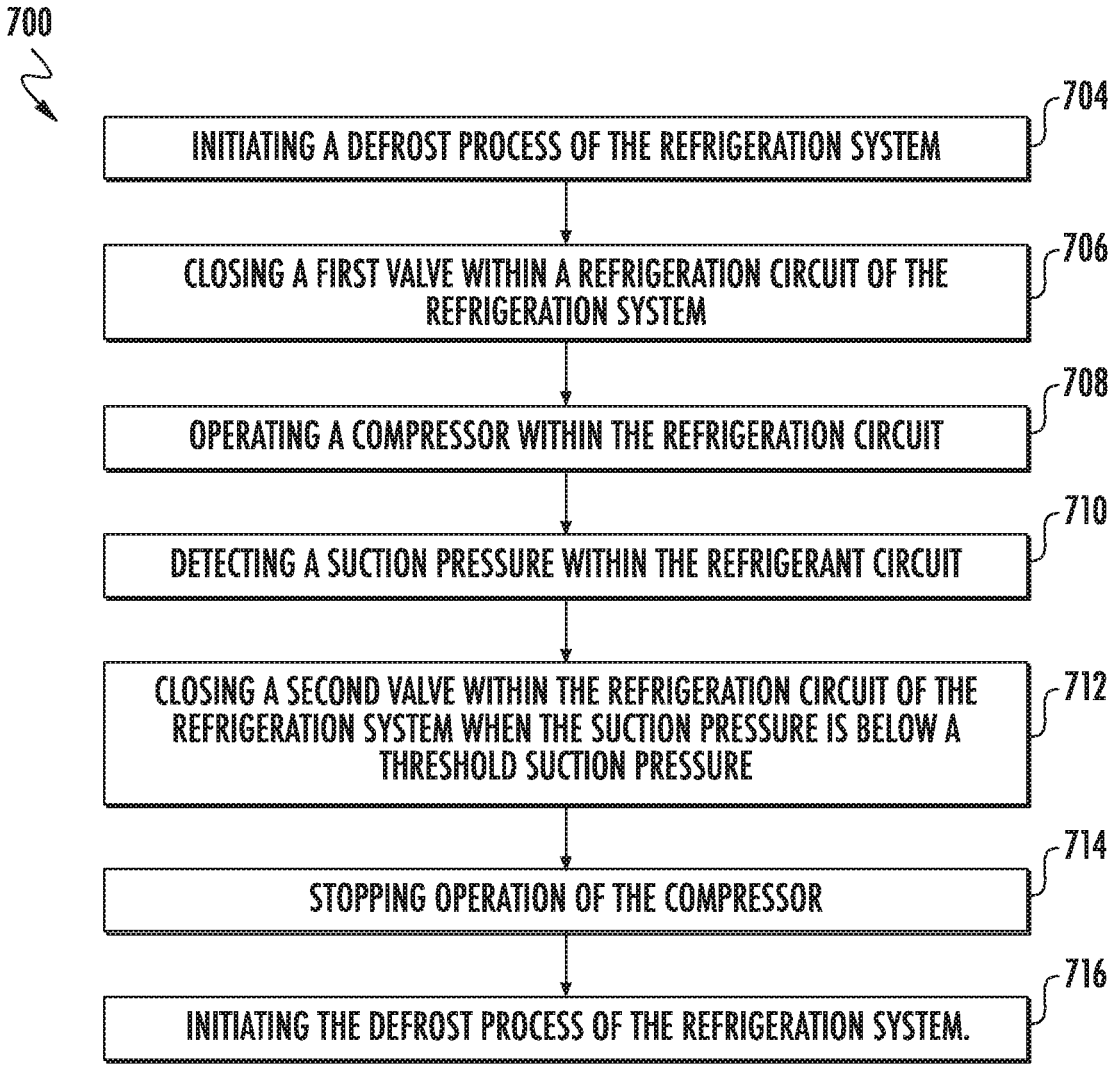
FIG. 4 is a flowchart illustrating a method of defrosting the refrigeration system of FIG. 2, according to an embodiment of the present disclosure.

Referring to FIG. 4, with continued reference to FIGS. 1 and 2, a method 700 of defrosting the refrigeration system 110 is illustrated in accordance with an embodiment of the present disclosure. In an embodiment, the method 700 may be performed by the controller 180 and/or the refrigeration system control input device 500.

At block 704, the defrost process of the refrigeration system 110 is initiated. The defrost process of the refrigeration system 110 may be initiated automatically or when a selection input is received from a user of a refrigeration system control input device 500 indicating that the user desires to initiate a defrost process of the refrigeration system 110. Block 704 may include that a graphical user interface 540 is generated on a display device 510 of the refrigeration system control input device 500 and a control icon 550B representing initiation of the defrost process is displayed. The selection input is received at the control icon 550B.

At block 706, a first valve 166 within a refrigerant circuit 116 of the refrigeration system 110 is closed. The first valve 166 is located within the refrigerant circuit 116 between the condenser 122 and the evaporator 124. Thus, closing the first valve 166 stops flow of refrigerant from the condenser 122 to the evaporator 124. In an embodiment, the first valve 166 is located outside of a conditioned space 112 of the refrigeration system 110.

At block 708, a compressor 120 within the refrigerant circuit 116 is operated. At block 710, a suction pressure within the refrigerant circuit 116 is detected. In an embodiment, the suction pressure is detected proximate a compressor 120 inlet of the compressor 120.

At block 712, a second valve 176 within the refrigerant circuit 116 of the refrigeration system 110 is closed when the suction pressure is below a threshold suction pressure. Closing the first valve 166 and the second valve 176 maintains the suction pressure below the threshold suction pressure. The second valve 176 may be located within the refrigerant circuit 116 between the compressor 120 and the condenser 122. Thus, closing the second valve 176 may stop flow of refrigerant from the compressor 120 to the condenser 122. In an embodiment, the second valve 176 is located outside of a conditioned space 112 of the refrigeration system 110. In an alternate embodiment, the second valve 176 may be interposed between the evaporator outlet 162 and the compressor inlet 140, as shown in FIG. 2 at 176A. The threshold suction pressure may be indicative that the refrigerant has been evacuated from the refrigerant circuit 116 between first valve 166 and the second valve 176. In other words, the threshold suction pressure may be indicative that the refrigerant has been evacuated from the refrigerant line 164 between the first valve 166 and the evaporator 124, the evaporator 124, the refrigerant line 169, the compressor 120, and the refrigerant line 156 between the compressor and the second valve 176.

At block 714, operation of the compressor 120 is stopped. At block 716, the defrost process of the refrigeration system 110 is initiated. The method 700 may further comprise that a heater 148 of the refrigeration system 110 is activated to prevent heating the refrigerant of the refrigeration system 110 during the defrost process. The heater 148 may be located proximate an evaporator 124 of the refrigeration system 110.

While the above description has described the flow process of FIG. 4 in a particular order, it should be appreciated that unless otherwise specifically required in the attached claims that the ordering of the steps may be varied.

The term "about" is intended to include the degree of error associated with measurement of the particular quantity based upon the equipment available at the time of filing the application.

The terminology used herein is for the purpose of describing particular embodiments only is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A method of shutting down or defrosting within a refrigeration system having a compressor, condenser, expansion valve and evaporator, the method, comprising:

initiating a shutdown process or a defrost process of the refrigeration system;

closing a first valve within a refrigerant circuit of the refrigeration system;

operating a compressor within the refrigerant circuit;

detecting a suction pressure within the refrigerant circuit;

closing a second valve within the refrigerant circuit of the refrigeration system when the suction pressure is below a threshold suction pressure; and stopping operation of the compressor;

wherein the first valve is located within the refrigerant circuit between a condenser and an evaporator, and wherein closing the first valve stops flow of refrigerant from the condenser to the evaporator;

wherein the second valve is located within the refrigerant circuit between the compressor and a condenser, and wherein closing the second valve, when the suction pressure is below a threshold suction pressure, stops flow of refrigerant from the compressor to the condenser.

2. The method of claim 1, further comprising:

receiving a selection input from a user of a refrigeration system control input device indicating that the user desires to initiate the shutdown process of the refrigeration system.

3. The method of claim 2, further comprising:

generating a graphical user interface on a display device of the refrigeration system control input device; and displaying a control icon representing initiation of the shutdown process, wherein the selection input is received at the control icon.

4. The method of claim 1, wherein the method is a method of shutting down the refrigeration system, wherein the method comprises initiating the shutdown process of the refrigeration system, the method further comprising:

stopping operation of the refrigeration system.

5. The method of claim 1, wherein the second valve is located between an evaporator outlet of an evaporator of the refrigeration system and a compressor inlet of the compressor.

6. The method of claim 1, wherein the suction pressure is detected proximate a compressor inlet of the compressor.

7. The method of claim 1, wherein the first valve is located outside of a conditioned space of the refrigeration system.

8. The method of claim 1, wherein closing the first valve and the second valve maintains the suction pressure below the threshold suction pressure.

9. The method of claim 1, wherein the method is a method of defrosting within the refrigeration system, wherein the method comprises initiating the defrost process of the refrigeration system, the method further comprising:

activating a heater of the refrigeration system.

10. The method of claim 9, wherein the heater is located proximate an evaporator of the refrigeration system.

* * * * *